US007870762B2

(12) United States Patent
Park et al.

(10) Patent No.: US 7,870,762 B2
(45) Date of Patent: Jan. 18, 2011

(54) DRUM WASHING MACHINE WITH STEAM INJECTION LATTICE

(75) Inventors: Young Hwan Park, Songpa-gu (KR); Na Eun Kim, Yeongdeungpo-gu (KR); Jae Won Chang, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 618 days.

(21) Appl. No.: 11/727,833

(22) Filed: Mar. 28, 2007

(65) Prior Publication Data

US 2007/0227201 A1 Oct. 4, 2007

(30) Foreign Application Priority Data

Mar. 30, 2006 (KR) ..... 10-2006-0028932

(51) Int. Cl.

| | |
|---|---|
| ***D06F 31/00*** | (2006.01) |
| ***D06F 37/00*** | (2006.01) |
| ***D06F 39/00*** | (2006.01) |
| *D06F 29/00* | (2006.01) |
| *D06F 35/00* | (2006.01) |

(52) U.S. Cl. ..... 68/5 R; 68/5 C; 68/207; 68/23.1

(58) Field of Classification Search ..... 68/3 R, 68/5 R, 5 C, 207

See application file for complete search history.

(56) References Cited

U.S. PATENT DOCUMENTS

| | | | | |
|---|---|---|---|---|
| 4,322,292 | A * | 3/1982 | Knox | 239/428.5 |
| 2005/0132504 | A1 * | 6/2005 | Yang et al. | 8/159 |

FOREIGN PATENT DOCUMENTS

| | | | |
|---|---|---|---|
| CN | 2301465 | | 12/1998 |
| CN | 1724742 | A | 1/2006 |
| DE | 4310594 | A1 * | 10/1994 |
| EP | 1375727 | A2 * | 1/2004 |
| EP | 1 541 739 | A2 | 6/2005 |
| EP | 1 619 286 | A2 | 1/2006 |
| EP | 1619286 | A2 * | 1/2006 |
| JP | 4-210091 | | 7/1992 |
| JP | 2006-61431 | | 3/2006 |
| KR | 10-2006-0009075 | | 1/2006 |
| KR | 2006114107 | A * | 11/2006 |
| WO | WO 2007145451 | A2 * | 12/2007 |

OTHER PUBLICATIONS

DE 43 10 594 English Translation.*
KR 2006-114107 Abstract.*
KR 2006-114107 Machine Translation.*

* cited by examiner

*Primary Examiner*—Michael Barr
*Assistant Examiner*—Charles W Kling
(74) *Attorney, Agent, or Firm*—McKenna Long & Aldridge LLP

(57) ABSTRACT

The present invention relates to a drum washing machine capable of re-circulating wash water to clean laundry with a relatively less amount of water. The drum washing machine includes a body, a drum rotatable in the body, wherein the drum comprises an opening formed in a predetermined portion of a circumference thereof and a hole formed in one side of the drum, a motor assembly mounted adjacent to the other side of the drum, wherein the other side of the drum is opposite to the hole, and an injection unit adjacent to the hole, wherein at least one of wash water or steam is injected into the drum through the hole.

9 Claims, 7 Drawing Sheets

DRUM WASHING MACHINE WITH STEAM INJECTION LATTICE

This application claims the benefit of Korean Patent Application No. 10-2006-0028932, filed on Mar. 30, 2006, which is hereby incorporated by reference for all purposes as if fully set forth herein.

BACKGROUND OF THE INVENTION

1. Field of the Invention

The present invention relates to a drum washing machine capable of re-circulating wash water to clean laundry with a relatively less amount of water.

2. Discussion of the Related Art

Generally, drum washing machines are home appliances that are used to clean laundry inside a drum by friction force between a rotary drum and laundry. Due to development of drum washing machines, laundry can be less damaged and less entangled and the laundry can be washed as if it were scrubbed by human hands.

A door is provided in a front part of a body in a conventional drum washing machine to load or unload laundry. When a user tries to put or take the laundry in or from a drum, the user should bend his/her waist or sit down, which is inconvenient to the user. The drum washing machine having a door provided in a front portion of its body will be referred to as a front loading-type drum washing machine.

Recently, top loading-type drum washing machines have been developed, in which an opening for loading/unloading laundry is formed in a circumference of a drum and a drum door is coupled to the opening. Thus, a user can open the door without bending his/her waist and can load or unload laundry inside the drum.

FIG. 1 illustrates a conventional top loading-type drum washing machine.

As shown in FIG. 1, a conventional top loading-type drum washing machine 1 includes a body 3, a tub 5 mounted within the body 3 to store wash water, and a drum 7 rotatable within the tub 5 to wash laundry therein.

There are provided in both sides of the drum a motor shaft 9, a spider 2, a motor 4 and a motor housing 6. The motor shaft 9 transmits rotational force to the drum 7. The spider 2 transmits the rotational force of the motor shaft 9 to the drum 7. A plurality of elastic members 8 may be provided under the tub 5 to support the tub 5.

According to the conventional top loading-type drum washing machine, the rotational force of the motor 7 is transmitted to the spider 2 via the motor shaft 9 and the drum 7 rotates during a washing and ringing cycle. The drum 7 rotates and the rotation of the drum 7 is damped by the elastic members 8 connected to the housing 6 in media of the bearing fastened to shafts provided in both sides of the drum 7.

Since the conventional top loading-type drum washing machine may not have any secured space connected to the drum, a nozzle used in a conventional front loading-type drum washing machine may not be installed in the conventional top loading-type drum washing machine and it is impossible to re-circulate wash water.

That is, as shown in FIG. 1, a drum operation mechanism is provided in a side of the drum and a mechanism for supporting rotation of the drum is provided in the other side of the drum. Hence, the overall drum is closed and it is impossible to install any means for connecting an inside of the drum to an outside of the drum.

SUMMARY OF THE INVENTION

Accordingly, the present invention is directed to a drum washing machine that substantially obviates one or more of the problems due to limitations and disadvantages of the related art.

An advantage of the present invention is to provide a top loading-type drum washing machine capable of re-circulating wash water to easily clean laundry with a relatively less amount of wash water.

Additional advantages, objects, and features of the invention will be set forth in part in the description which follows, and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum washing machine includes a body; a drum rotatable in the body, wherein the drum comprises an opening formed in a predetermined portion of a circumference thereof and a hole formed in one side of the drum; a motor assembly mounted adjacent to the other side of the drum, wherein the other side of the drum is opposite to the hole; and an injection unit adjacent to the hole, wherein at least one of wash water or steam is injected into the drum through the hole.

In another aspect of the present invention, the drum washing machine further includes at least one bracket unit provided in the other side of the drum. The bracket is secured to the motor assembly and the body to support the drum.

The bracket unit includes at least one bracket secured to the motor assembly to support the drum; and at least one damper for damping vibration of the drum. One end of the damper fastened to the bracket and the other end of the damper fastened to the body.

The injection unit includes an injection nozzle adjacent to the hole to inject at least one of the wash water or steam into the drum through the hole.

In another aspect of the present invention, the drum washing machine may further include a nozzle window. At least one of the wash water or steam injected through the nozzle dampens laundry inside of the drum smoothly.

The nozzle window may include a lattice provided in some portion or an overall portion of the hole.

The nozzle window may include a lattice provided in some portion or overall portion of the hole, the lattice having an appearance substantially radial shape.

The hole may be formed in a substantially donut shape with respect to a center of one side of the drum.

A center of the hole may be spaced apart a predetermined distance from a center of one side of the drum.

The motor assembly includes a motor provided in one side of the drum to operate the drum; and a motor housing for mounting the motor. An end of the bracket is secured to the motor housing, and the other end of the bracket is bent and secured to an upper end of the damper.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiments of the invention and together with the description serve to explain the principle of the invention.

In the drawings.

DETAILED DESCRIPTION

Reference will now be made in detail to the specific embodiments of the present invention, examples of which are illustrated in the accompanying drawings. Wherever possible, the same reference numbers will be used throughout the drawings to refer to the same or like parts.

Figure 1:
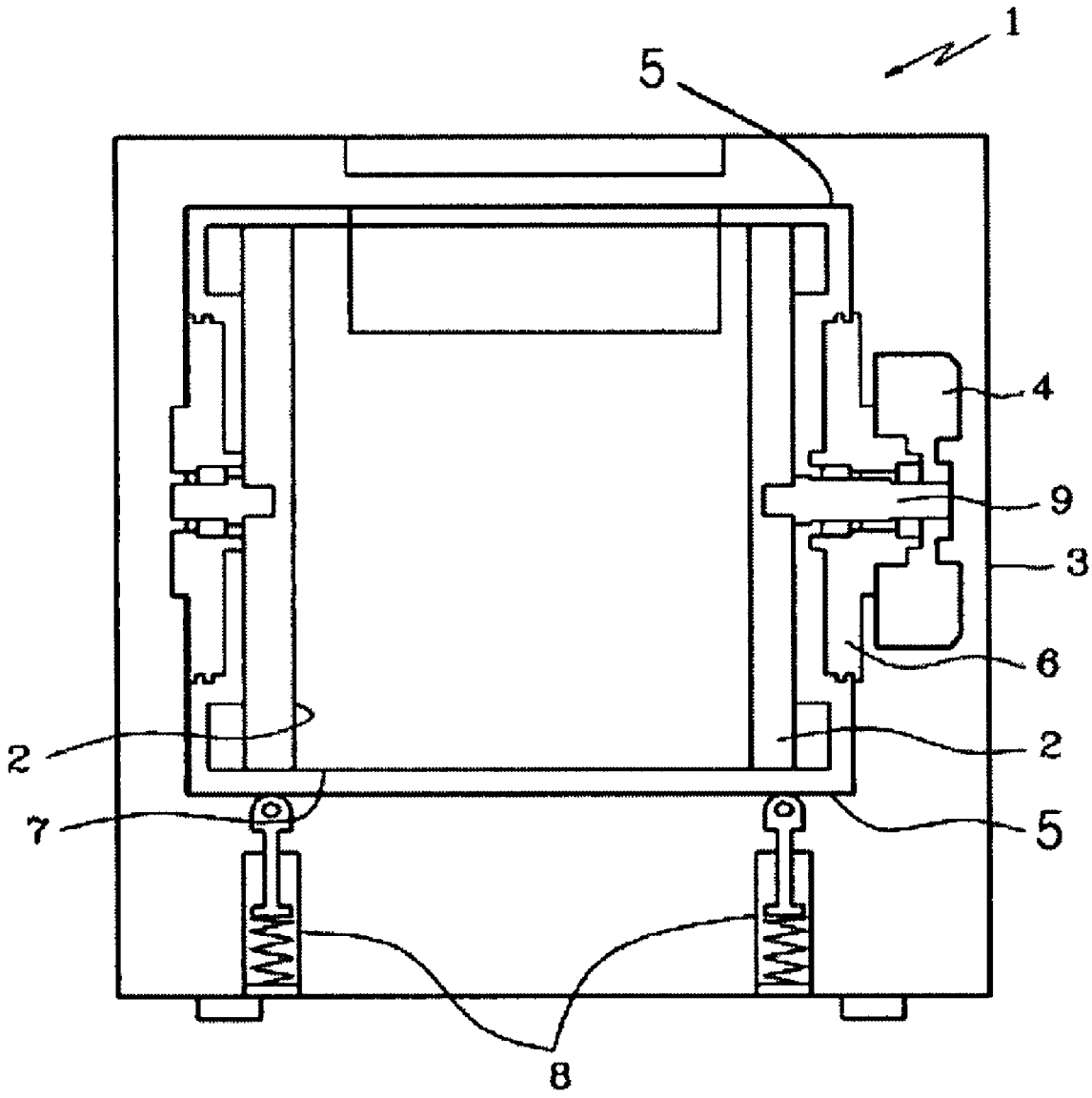
FIG. 1 RELATED ART
FIG. 1 is a diagram schematically illustrating key parts of a conventional drum washing machine.
Figure 2:
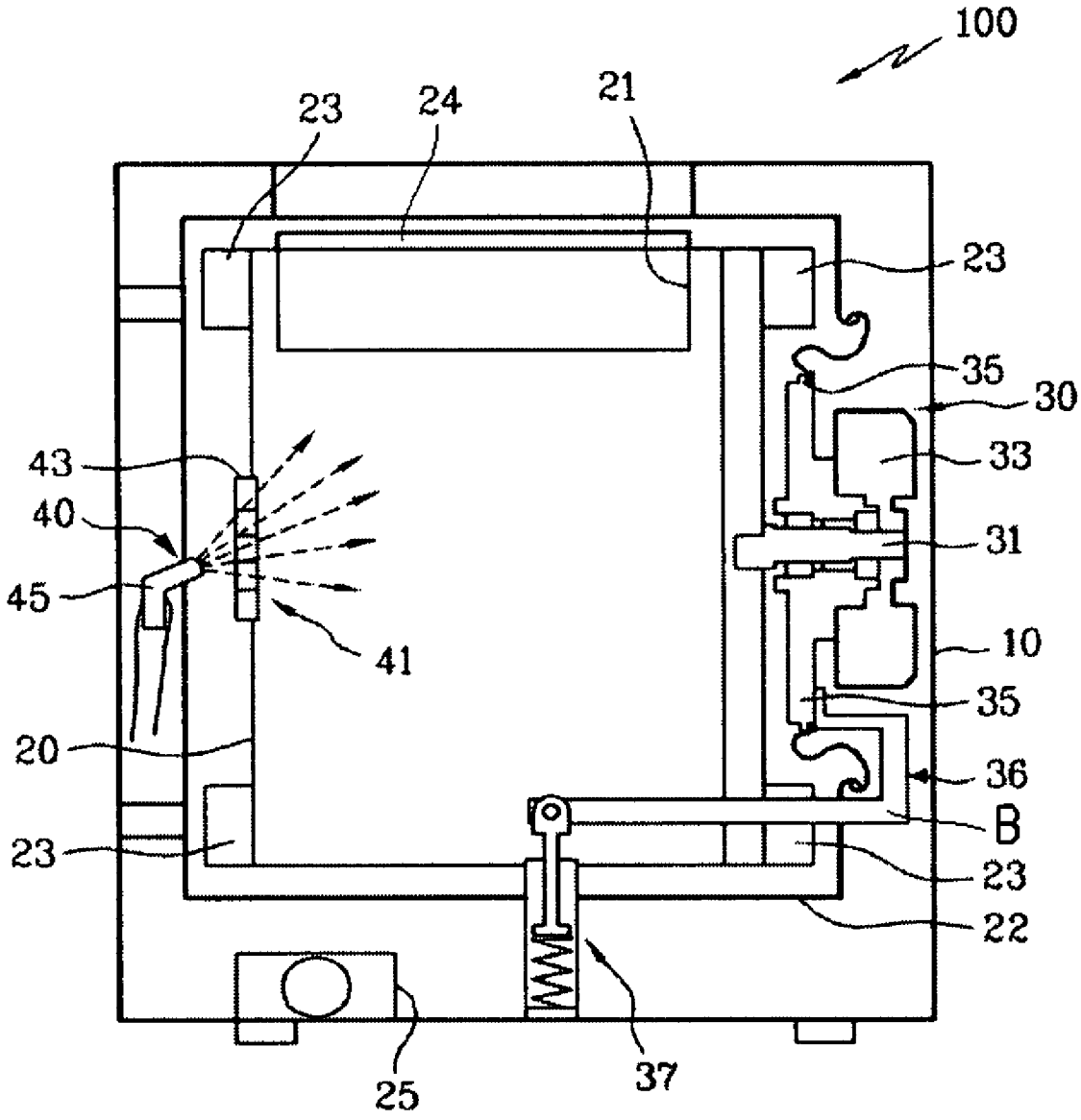
FIG. 2 is a diagram schematically illustrating key parts of a drum washing machine according to an embodiment of the present invention.
Figure 3:
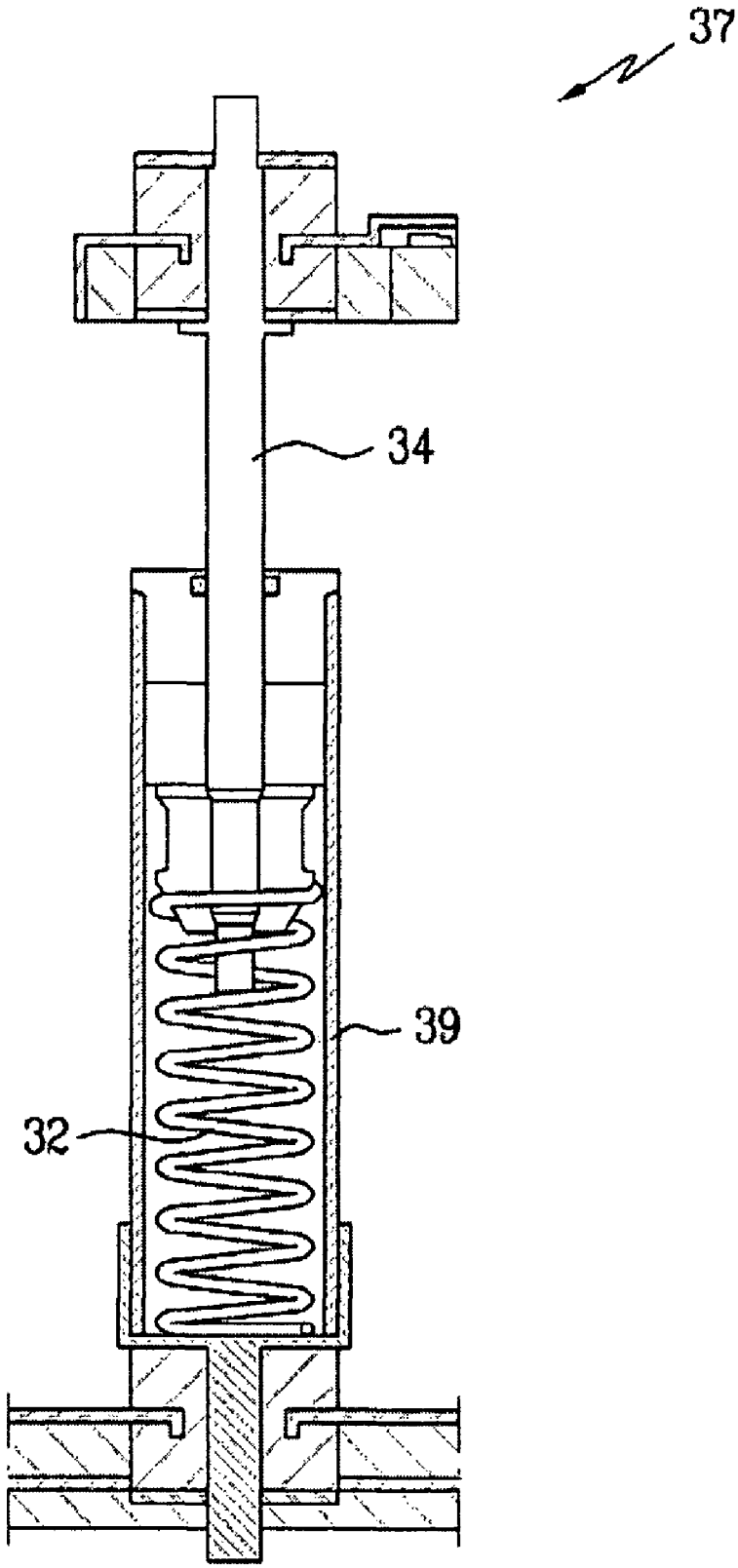
FIG. 3 is a sectional view schematically illustrating a damper shown in FIG. 2.

FIG. 2 schematically illustrates key parts of a drum washing machine according to an embodiment the present invention and FIG. 3 schematically illustrates a damper shown in FIG. 2. FIGS. 4 to 7 illustrate embodiments of the drum washing machine according to the present invention, respectively.

As shown in FIG. 2, a drum washing machine 100 includes a body 10, a drum 20, a tub 22, a motor assembly 30 and an injection unit 40. The drum is rotatable within the body 10. An opening 21 is formed in a predetermined portion of a circumference of the drum 20 and a hole 41 is formed in one side of the drum 20. The tub 22 is installed to cover the drum 20 and it stores wash water therein. The motor assembly 30 is mounted adjacent to the other side of the drum 20, which is opposite to the hole 41, and it operates the drum 20. The injection unit 40 is adjacent to the hole 41 to inject at least one of wash water or steam into the drum 20 through the hole 41.

Also, the drum washing machine shown in FIG. 2 includes the motor assembly 30 as a drum operation mechanism, which is provided in the other side of the drum 20, a bracket unit 36 and a damper 37 as a drum supporting mechanism, and the injection unit 40 for injecting at least one wash water or steam into the drum 20 through the hole 41 formed in the other side of the drum 20, in which the hole is formed, to communicate with the inside of the drum 20.

The opening 21 is in communication with the inside of the drum 20 so that a user may load laundry into the drum 20 through the opening 21. Thus, it is preferred that an upper end of the tub 22, that covers the drum 20, and an upper end of the body 10, that covers the tub 22, are opened corresponding to the opening 21.

The drum 20 includes a drum door 24 for closing the opening 21. The drum door 24 may be sliding to close the opening 21 or one side of the drum door 24 may have a hinge structure to close the opening 21.

The motor assembly 30 is provided in the other side of the drum 20, which is opposite to the hole 41, to operate the drum 20 so that the drum performs washing. Here, the motor assembly 30 includes a motor 33 and a motor housing 35.

The motor 33 includes a motor operation shaft 31 connected to the drum 20 and thus the motor 33 transmits a driving force to the drum 20 via the motor operation shaft 31. The motor 33 is secured to the other side of the drum 20 by the motor housing 35.

As mentioned above, the hole 41 is provided in one side of the drum 20 in communication of the inside of the drum 20. Together with the hole 41, the injection unit 40 is also provided in the one side of the drum 20, adjacent to the hole 41. Thus, at least one of wash water or steam is injected into the drum 20 through the hole 41 by the injection unit 40.

As shown in FIG. 2, the injection unit 40 includes an injection nozzle 45 adjacent to the hole 41. Also, the injection unit 40 may include an injection spray mechanism that sprays wash water or steam into the drum 20 through the hole 41. That is, the injection unit 40 may includes all kinds of structures that can supply wash water or steam into the drum 20 in a predetermined pressure and speed, for example injecting or spraying, to make wash water or steam reach the laundry adhering to inner surfaces of the drum 20. If the injection unit 40 injects steam, a steam generation part may be connected to the injection unit 40, though not shown in the drawings. The drum washing machine of the embodiment of FIG. 2 further includes a nozzle window 43 provided at a hole provided at one side of the drum. The nozzle window 43 orients wash water or steam injected through an injection unit 40 to dampen the laundry inside of the drum smoothly.

The drum washing machine according to the present invention is a top loading-type drum washing machine characterized in that the drum is supported in one side and the injection unit is provided in the other side of the drum to inject at least one of wash water or steam into the drum.

When the drum is supported in one side, vibration may be generated severely and the supporting force may be insufficient during the drum rotation. As a result, the drum and the motor assembly provided in one side of the drum might collide against each other and become damaged.

To damp the vibration and supply the sufficient supporting force, the drum washing machine according to the present invention may further include a bracket unit.

As shown in FIG. 2, the bracket unit includes at least one bracket 36 and at least one damper 37. The bracket 36 is fastened to the motor assembly 30 to support the drum 20. One end of the damper 37 is fastened to the bracket 36 and the other end of the damper 37 is fastened to the body 10 to damp the vibration of the drum 20 transmitted through the bracket 36.

One end of the bracket 36 is secured to a predetermined portion of the motor housing 35 and the other end of the bracket 36 is secured to an upper end of the damper 37. It is preferred that the bracket 36 is provided in plural, considering safety of drum operation.

As shown in FIG. 2, one end of the bracket 36 is secured to the motor housing 35 and thus the vibration of the drum 20 is transmitted through the bracket 36 during the drum rotation. The other end of the bracket 36 is movable due to the vibration of the drum 20.

Since the damper fastened to the other end of the bracket 36 damps the motion of the other end of the bracket 36, the vibration generated from the drum rotation may be effectively damped.

Here, the bracket 36 is bent at a predetermined portion and a bending part (B) is formed at the bracket 36 to damp some of the vibration of the drum before the vibration is transmitted to the damper 37.

The damper 37 may be fixed under the rotation center of the drum 20 within the body 10. The rotation center of the drum 20 is a rotation center in connection with the weight of components related to the drum rotation.

As shown in FIG. 3, the damper 37 of the embodiment of FIG. 2 may include a damper housing 39, an elastic member 32 and a piston member 34. The damper housing 39 is mounted in the body 10. The elastic member 32 is provided in a longitudinal direction of the damper housing 39. The piston member 34 is movable upward/downward along the longitudinal direction of the damper housing 39.

The other end of the bracket 36 is fastened to an upper end of the piston member 34 and the elastic member 32 is provided at a lower end of the piston member 34, to support the piston member 34.

Fluid having high coefficient of viscosity may be provided within the damper housing 39 and the portion through which the fluid is filled is tightly sealed, such that the damping efficiency of the damper 37 may be enhanced.

As shown in FIG. 2, balancing members 23 are provided at four side ends of the drum 20, respectively. Also, a pump 25 is provided on an inner bottom surface of the body 10 to pump wash water so that the wash water is injected into the drum by the injection unit 40.

Embodiments shown in FIGS. 4 to 7 will be now described.

As shown in FIGS. 4 to 7, a drum washing machine according to the present invention further includes a nozzle window 43, 63 and 73 provided at a hole provided at one side of a drum. The nozzle window 43, 63 and 73 orients wash water or steam injected through an injection unit to dampen the laundry inside of the drum smoothly.

Figure 4:
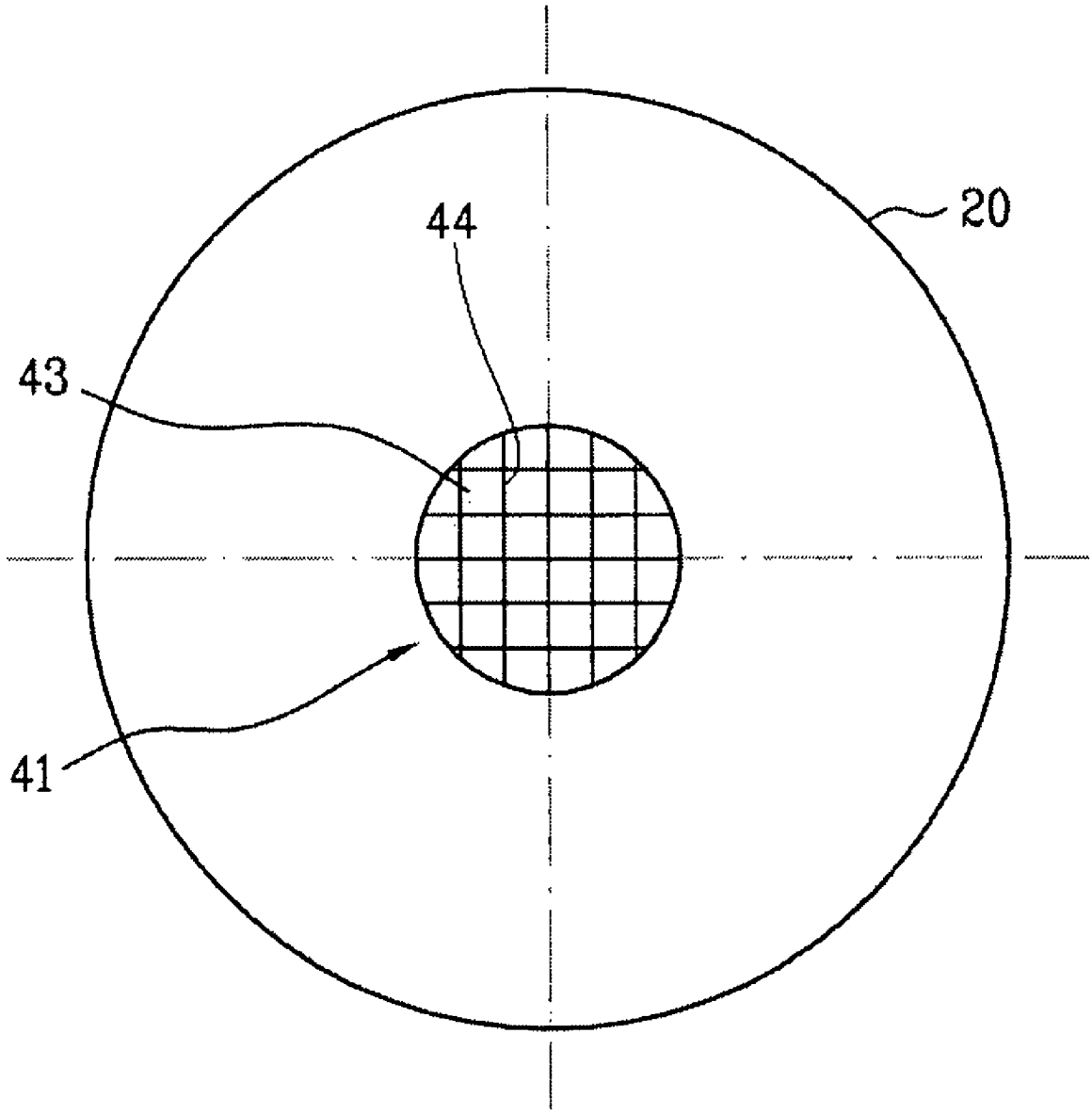
FIGS. 4 to 7 are diagrams illustrating embodiments of the drum washing machine according to the present invention.

According to a first embodiment, as shown in FIG. 4, the nozzle window 43 may be provided at some portion or an overall portion of the hole 41 in a lattice shape. In other words, the nozzle window 43 is formed by a lattice 44.

The injection unit 40 is installed adjacent to the nozzle window 43. The hole 41 is provided in a center of one side of the drum 20 and the nozzle window 43 is provided at an overall portion of the hole 41 or provided at a predetermined portion of a center of the hole 41.

Thus, wash water or steam may be distributed over the inside of the drum 20 by the lattice 44 of the nozzle window 43, or a motion path of the wash water or steam injected in a predetermined pressure and speed is changed to uniformly supply the wash water or steam to the laundry. Especially, when a soaking cycle is performed, the laundry may be adhering to an inner surface of the drum during the drum rotation. At this time, the lattice 44 of the nozzle window 43 allows the wash water or steam to be supplied to and to dampen the laundry adhering to the inner surface of the drum 20 uniformly.

Figure 5:
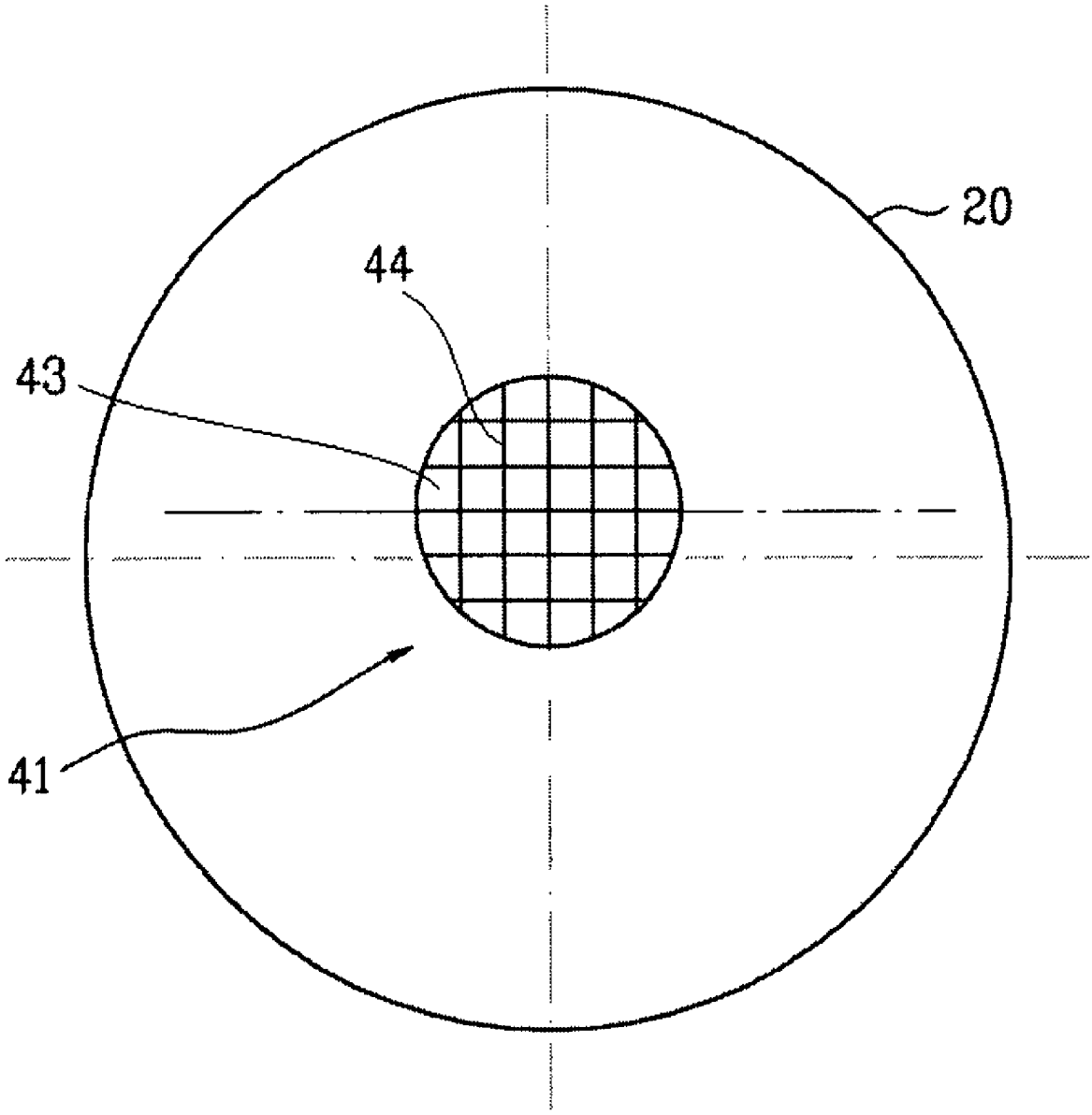

FIG. 5 illustrates a nozzle window and a lattice according a second embodiment.

As shown in FIG. 5, a hole 41 provided at one side of the drum 20 and a center of the hole 41 is spaced apart a predetermined distance from a center of one side of the drum 20.

That is, the hole 41 is eccentric from the center of one side of the drum 20 and it rotates eccentrically when the drum 20 rotates. Accordingly, the nozzle window 43 eccentrically rotates with respect to the center of the drum 20 such that the wash water or steam injected by the injection unit may easily reach the laundry adhering to the inner surface of the drum 20 through the nozzle window 43.

Figure 6:
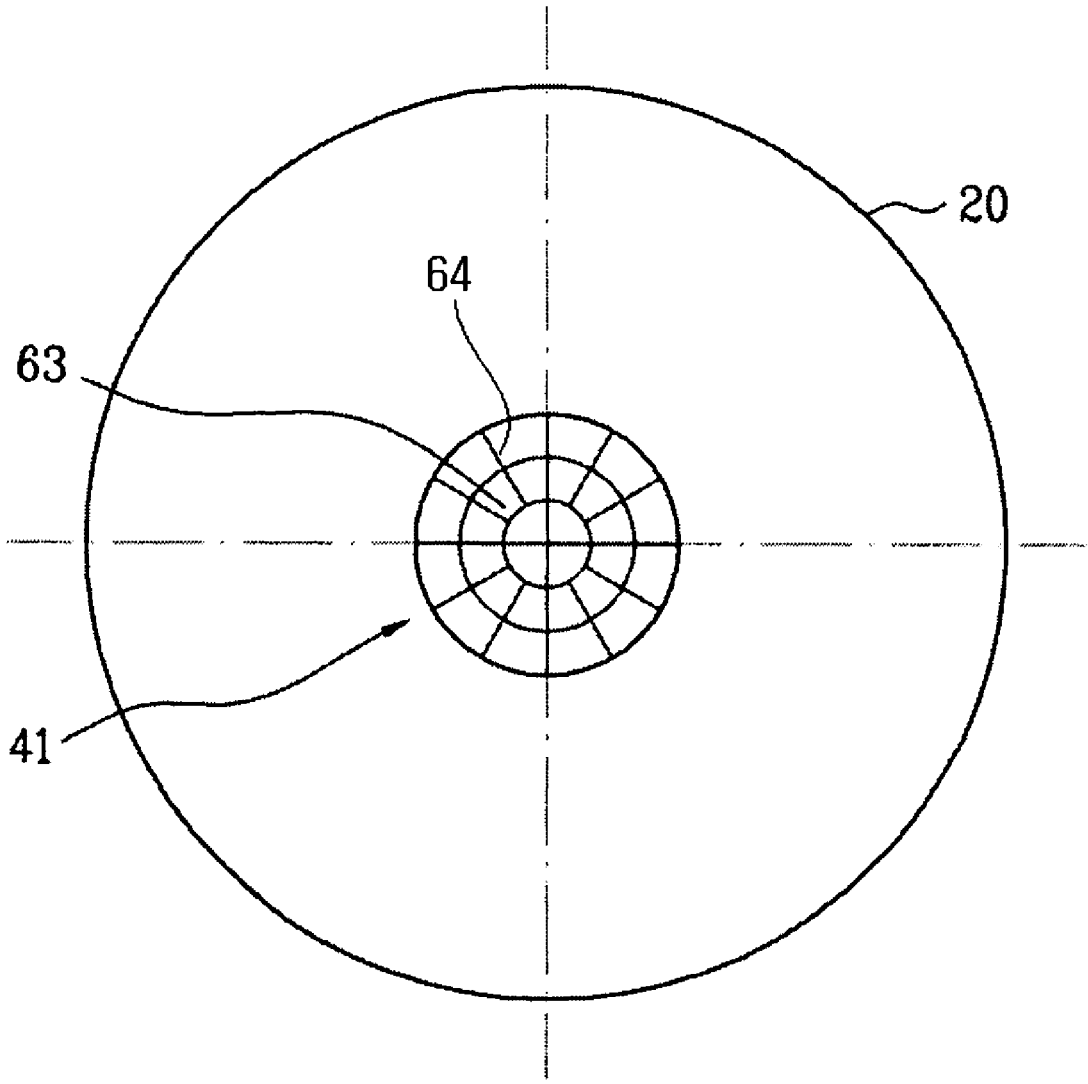

FIG. 6 illustrates a nozzle window 63 and a lattice 64 according to a third embodiment.

As shown in FIG. 6, the nozzle window 63 is radial from a center of one side of the drum 20. That is, a lattice 64 having a radial shape is provided at the hole 41 and the radial shaped nozzle window 63 is formed by the radial shaped lattice 64. The nozzle window 63 is provided in a radial shape and the wash water or steam is injected in all direction, that is, a radial direction.

Figure 7:
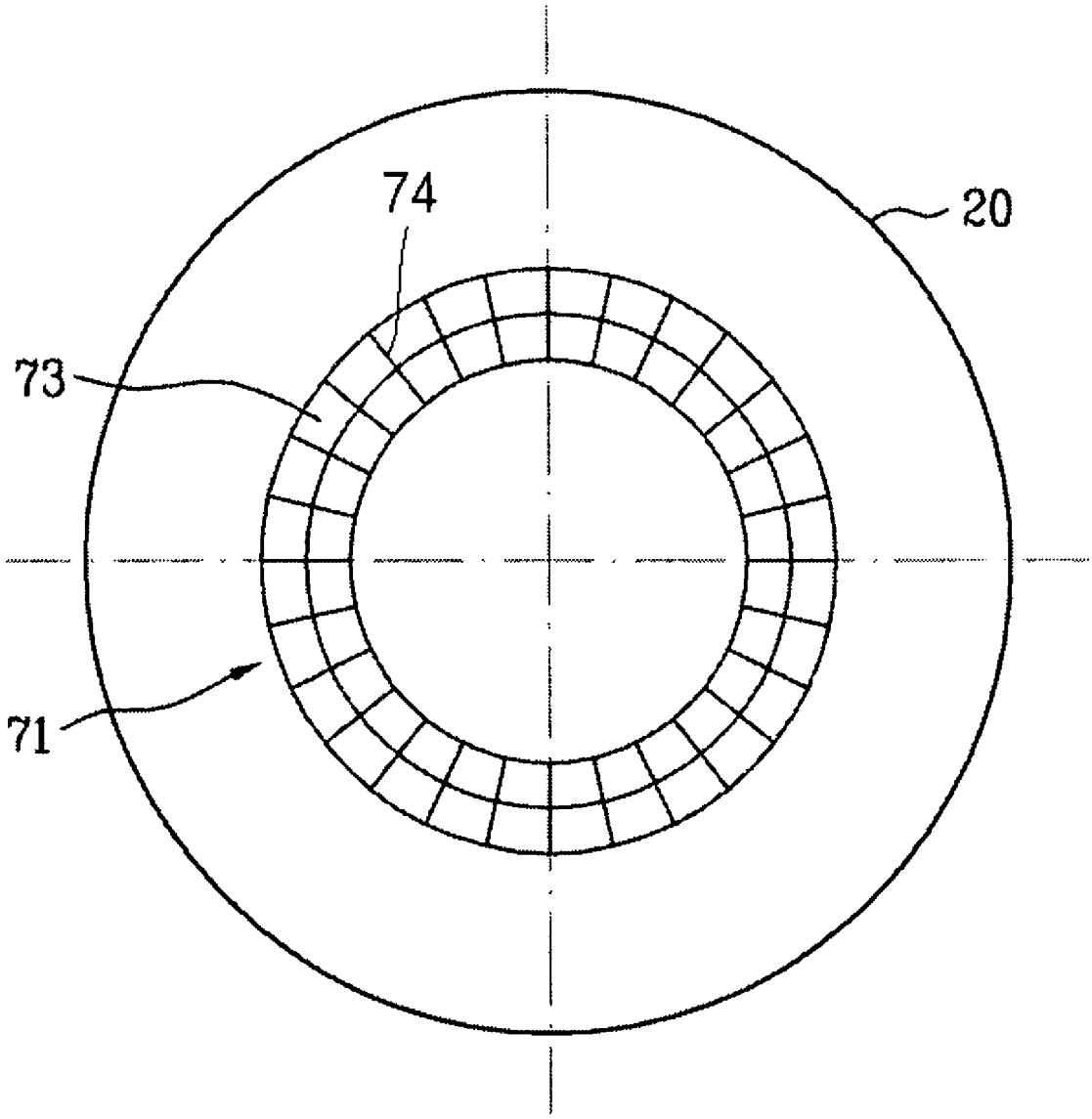

FIG. 7 illustrates a nozzle window 73 and a lattice 74 according to a fourth embodiment.

As shown in FIG. 7, the nozzle window 73 is formed in a donut shape with respect to the center of one side of the drum 20. For the donut shaped nozzle window 73, a hole 71 is also formed in a donut shape with respect to the center of one side of the drum 20. The nozzle window 73 is formed at one side of the drum 20 in a donut shape, such that wash water may be injected to an upper and lower part of the laundry uniformly.

As mentioned above, in the drum washing machine according to the present invention, which is a top loading-type, the predetermined components to support the drum may be provided in one side of the drum and not provided in the other opposite side of the drum. Thus, inner space of the drum may be relatively wide and washing capacity may be enhanced, compared to the same overall size of a conventional top loading-type drum washing machine as well as a conventional front loading-type drum washing machine.

Moreover, while there are provided in one side of the drum the components for supporting the drum, there are provided in the other side of the drum the injection unit for injecting at least one of wash water or steam. At least one of wash water or steam is injected into the drum through the hole and thus washing efficiency is high even with a relatively small amount of wash water.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum washing machine comprising:

a body;

a drum rotatably installed in the body, wherein the drum comprises an opening for loading and unloading laundry formed in a predetermined portion of a circumference thereof and a hole formed in one side of the drum;

a motor assembly mounted adjacent to the other side of the drum, wherein the other side of the drum is substantially opposite to the hole;

a steam generation part; and an injection unit adjacent to the hole, wherein steam generated by the steam generation part is injected into the drum through the hole, wherein the one side of the drum includes a nozzle window provided at the hole, wherein the nozzle window includes a lattice at the hole in the one side of the drum to distribute the steam over an inside of the drum.

2. The drum washing machine of claim 1, further comprising at least one bracket unit provided in the other side of the drum, wherein the bracket unit is secured to the motor assembly and the body to support the drum.

3. The drum washing machine of claim 2, wherein the injection unit comprises an injection nozzle adjacent to the hole to inject the steam into the drum through the hole.

4. The drum washing machine of claim 3, wherein a center of the hole is spaced apart a predetermined distance from a center of the one side of the drum.

5. The drum washing machine of claim 1, further comprising at least one bracket unit, wherein the bracket unit comprises:

at least one bracket secured to the motor assembly to support the drum; and at least one damper for damping vibration of the drum, wherein an upper end of the damper is fastened to the at least one bracket and the other end of the damper is fastened to the body.

6. The drum washing machine of claim 5, wherein the motor assembly comprises:

a motor to operate the drum; and a motor housing for mounting the motor, wherein one end of the at least one bracket is secured to the motor housing, and the other end of the at least one bracket is bent and secured to the upper end of the damper.

7. The drum washing machine of claim 1, wherein the lattice is provided in some portion or an overall portion of the hole.

8. The drum washing machine of claim 7, wherein the hole is formed in a substantially donut shape with respect to a center of the one side of the drum.

9. The drum washing machine of claim 1, wherein the lattice has a substantially radial shape.

* * * * *